US010721806B1

(12) United States Patent
Tye, Jr. et al.

(10) Patent No.: US 10,721,806 B1
(45) Date of Patent: Jul. 21, 2020

(54) AUDITORIUM HOUSE LIGHT POSITIONING SYSTEM

(71) Applicant: Tempo Industries, LLC, Irvine, CA (US)

(72) Inventors: Garry Lee Tye, Jr., Ontario, CA (US); Shaun Toms, Fontana, CA (US); Jason Thomas Luck, Chino, CA (US)

(73) Assignee: Tempo Industries, LLC, Irvine, CA (US)

( * ) Notice: Subject to any disclaimer, the term of this patent is extended or adjusted under 35 U.S.C. 154(b) by 0 days.

(21) Appl. No.: 16/392,293

(22) Filed: Apr. 23, 2019

Related U.S. Application Data

(60) Provisional application No. 62/826,689, filed on Mar. 29, 2019.

(51) Int. Cl.

| | |
|---|---|
| ***F21S 8/04*** | (2006.01) |
| ***H05B 47/155*** | (2020.01) |
| ***F21S 4/28*** | (2016.01) |
| ***F21V 5/00*** | (2018.01) |
| ***F21V 3/02*** | (2006.01) |
| ***F21V 5/04*** | (2006.01) |
| *F21Y 103/10* | (2016.01) |
| *F21W 111/02* | (2006.01) |
| *F21W 131/406* | (2006.01) |
| *F21W 131/407* | (2006.01) |
| *F21Y 115/10* | (2016.01) |

(52) U.S. Cl.
CPC ..... *H05B 47/155* (2020.01); *F21S 4/28* (2016.01); *F21S 8/04* (2013.01); *F21V 3/02* (2013.01); *F21V 5/007* (2013.01); *F21V 5/045* (2013.01); *F21W 2111/02* (2013.01); *F21W 2131/406* (2013.01); *F21W 2131/407* (2013.01); *F21Y 2103/10* (2016.08); *F21Y 2115/10* (2016.08)

(58) Field of Classification Search
CPC ..... F21S 4/28; F21S 8/04; F21W 2131/406
USPC ..... 362/249.02
See application file for complete search history.

(56) References Cited

U.S. PATENT DOCUMENTS

| | | | | |
|---|---|---|---|---|
| 6,351,920 | B1 | 3/2002 | Hopkins et al. | |
| 7,658,518 | B2 | 2/2010 | Shwisha | |
| 9,062,840 | B2 | 6/2015 | Swisha et al. | |
| 9,217,247 | B2 | 12/2015 | Behling et al. | |
| 9,458,995 | B1 | 10/2016 | Pearson et al. | |
| 9,596,740 | B2 | 3/2017 | Pearson et al. | |
| 9,803,807 | B2 | 10/2017 | Pearson et al. | |
| 10,222,012 | B2 | 3/2019 | Kim et al. | |
| 10,295,161 | B1 * | 5/2019 | Shih | F21V 21/15 |
| 2003/0107888 | A1 * | 6/2003 | Devlin | G08C 23/04 362/233 |
| 2006/0238136 | A1 | 10/2006 | Johnson, III et al. | |
| 2009/0262532 | A1 | 10/2009 | Wilcox et al. | |
| 2010/0259931 | A1 | 10/2010 | Chemel et al. | |

(Continued)

OTHER PUBLICATIONS

Mci Application Guide, Mirror actuator 300 series, Jun. 28, 2016, pp. 1-13.

*Primary Examiner* — Christopher M Raabe
(74) *Attorney, Agent, or Firm* — Lapple Ubell IP Law, LLP; Franklin D. Ubell

(57) ABSTRACT

A positioning system for a ceiling based LED light module configured to illuminate auditorium aisle ways which provides rotational positioning of the LED light module about a vertical axis as well as pivotal positioning of the light module about orthogonal X and Y axes.

23 Claims, 15 Drawing Sheets

(56) References Cited

U.S. PATENT DOCUMENTS

| | | | | |
|---|---|---|---|---|
| 2012/0051041 | A1 | 3/2012 | Edmond et al. | |
| 2012/0063138 | A1 | 3/2012 | Leadford et al. | |
| 2012/0091903 | A1 | 4/2012 | Bembridge et al. | |
| 2012/0235579 | A1* | 9/2012 | Chemel | F21V 21/15 315/152 |
| 2013/0021792 | A1 | 1/2013 | Snell et al. | |
| 2013/0070461 | A1 | 3/2013 | Pickard | |
| 2013/0155672 | A1* | 6/2013 | Vo | F21S 8/00 362/233 |
| 2013/0176722 | A1 | 7/2013 | Lay et al. | |
| 2013/0201674 | A1 | 8/2013 | Pickard et al. | |
| 2013/0208457 | A1 | 8/2013 | Durkee et al. | |
| 2013/0208469 | A1 | 8/2013 | Progl | |
| 2013/0250567 | A1 | 9/2013 | Edmond et al. | |
| 2014/0016315 | A1 | 1/2014 | Yu | |
| 2018/0038562 | A1* | 2/2018 | Kim | F21S 8/04 |

* cited by examiner

AUDITORIUM HOUSE LIGHT POSITIONING SYSTEM

RELATED APPLICATIONS

This application claims the benefit of and priority to U.S. Provisional Patent Application Ser. No. 62/826,689, filed Mar. 29, 2019 having the same title, the contents of which Application is incorporated by reference in its entirety herein.

FIELD OF THE DISCLOSURE

The subject disclosure relates to ceiling-based LED lighting apparatus for lighting pathways or aisle ways in, for example, auditoriums and motion picture theatres, and more particularly to a positioning system for ceiling based auditorium aisle lighting apparatus.

DESCRIPTION OF RELATED ART

Auditorium lighting apparatus has been provided in the past, for example, as illustrated in U.S. Pat. Nos. 9,596,740, and 10,222,012, both assigned to Tempo Industries, LLC, Irvine, Calif., the assignee of the subject application

SUMMARY

According to illustrative embodiments, auditorium pathways, such as vertical and horizontal aisle ways of a motion picture theatre are illuminated by light modules located above the pathways, whose light is focused into a light beam of a width selected to illuminate the pathway. Further according to illustrative embodiments, a positioning system is provided to enable adjustment of the positioning of the light modules so as to more accurately direct light to the path or aisle way.

According to one illustrative embodiment, lighting apparatus is provided comprising an LED light module, a positioning motor, a rotator assembly, and a mounting track configured to be attached to a ceiling. The positioning motor has a fixed portion and a movable portion, the moveable portion being configured to move so as to provide pivotal positioning of the LED light module about orthogonal X and Y axes. The rotator assembly rotatably attaches the fixed portion of the positioning motor to the mounting track and thereby provides rotational positioning of the light module about a vertical axis.

In an illustrative embodiment, the rotator assembly comprises a first indexer component and a second indexer component configured to be rotatable with respect to one another about the vertical axis through a selected range of positions. The first indexer component is attached to the mounting track, while the second indexer component is attached to the fixed portion of the positioning motor. The LED light module is configured to light an aisle way from a position located above the aisle way and removably attaches to the movable portion of the positioning motor.

According to another aspect of the disclosure, apparatus for use in controlling positioning of an LED light module is provided comprising a mounting track mountable in a ceiling of an auditorium and a positioning motor having a fixed portion at a first end thereof and a movable portion at an opposite end, the moveable portion being configured to move with respect to the fixed portion so as to provide pivotal positioning of the moveable portion about orthogonal X and Y axes. A rotator assembly is further provided comprising a first indexer component and a second indexer component configured to be rotatable with respect to one another about a vertical axis through a selected range of positions. The second indexer component is attached to the fixed portion of the positioning motor so as to enable rotational positioning of the positioning motor about the vertical axis.

According to another aspect of the disclosure, apparatus for use in controlling positioning of an LED light module is provided comprising a positioning motor having a fixed portion at a first end thereof and a movable portion at an opposite end, the moveable portion being configured to move with respect to the fixed portion so as to provide pivotal positioning of the moveable portion about orthogonal X and Y axes.

According to another aspect of the disclosure, apparatus for use in controlling positioning of an LED light module is provided comprising a rotator assembly for rotating a positioning motor which controls positioning of an LED light module. In an illustrative embodiment, the rotator assembly comprises a first indexer component and a second indexer component configured to be rotatable with respect to one another about a vertical axis through a selected range of positions.

According to another aspect of the disclosure, lighting apparatus is provided comprising an LED light module and a positioning motor, the positioning motor having a fixed portion and a movable portion, the moveable portion being configured to move so as to provide pivotal positioning of an LED light module about orthogonal X and Y axes.

According to another aspect of the disclosure, lighting apparatus is provided comprising an LED module and a rotator assembly, the rotator assembly comprising a first indexer component and a second indexer component configured to be rotatable with respect to one another about a vertical axis through a selected range of positions.

According to another aspect, the rotator assembly according to the preceding paragraph may comprise the first indexer component being attached to a mounting track, and the second indexer component being attached to a fixed portion of a positioning motor.

According to an illustrative embodiment, an LED light module may comprise a plurality of LEDs, a plurality of vertical baffles, and a plurality of first apertures, each first aperture being disposed between a pair of the vertical baffles and over a respective one of the LEDs. A glare shield may mount over the plurality of baffles and has a plurality of second apertures therein, each second aperture overlying a respective one of the first apertures, and a lens is disposed between the second apertures and the LEDs.

DETAILED DESCRIPTION

Figure 1:
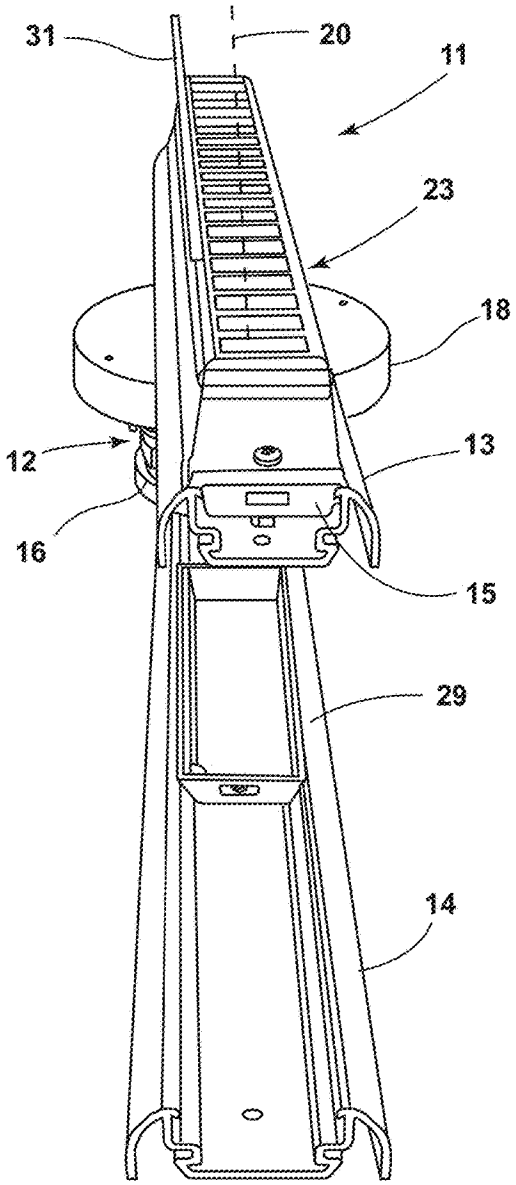
FIG. 1 is a perspective view of a ceiling-based LED module and positioning system therefor according to an illustrative embodiment.

FIG. 1 illustrates an LED auditorium house light positioning system according to an illustrative embodiment. The system includes a ceiling track mounting assembly 14, a rotator assembly 16, a positioning motor 12, and an LED light module 11. The ceiling track mounting assembly 14 facilitates attaching the system to a ceiling of an auditorium, the rotator assembly 16 enables rotating the LED light module 11 about a vertical axis 20 of the system, and the positioning motor 12 enables pivotal positioning of the LED light module 11, as described in more detail below.

Figure 2:
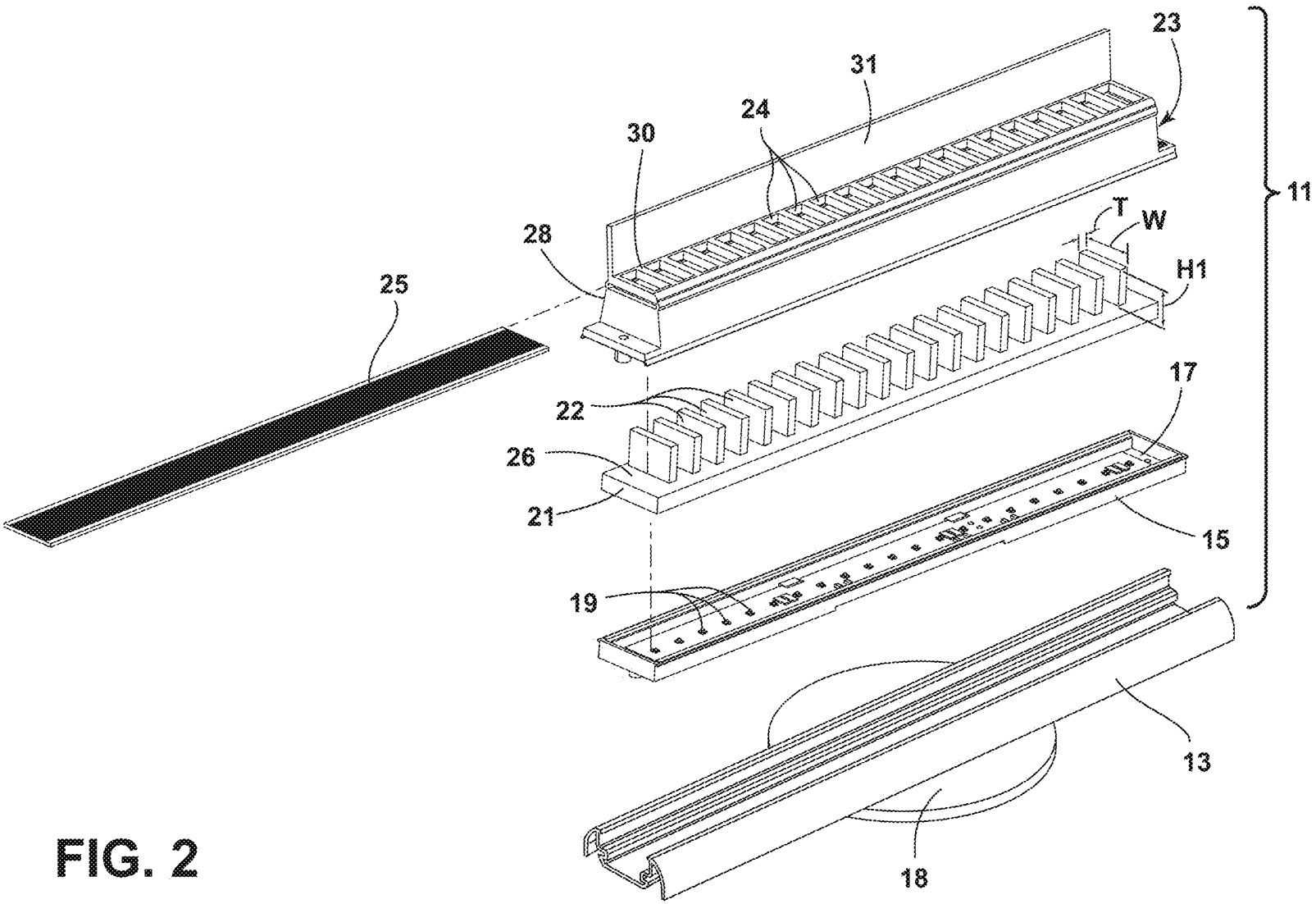
FIG. 2 is perspective view of an LED light module according to an illustrative embodiment.

An illustrative ceiling-based LED light module 11 is shown in FIG. 2. The light module 11 includes an LED circuit board 13, which slidably mounts into a base 13. A circular disc component 18 attaches to the base 13 and is configured to removably attach to a moveable portion of the positioning motor 12.

The LED circuit board 13 includes an LED circuit board mounting platform 15, which mounts an LED circuit board 17 carrying one or more LEDs, e.g. 19. In one embodiment, there may be twenty one LEDs 19. The illustrative embodiment of FIG. 2 further includes an LED horizontal baffle/aperture component 21, an LED glare shield 23, a collimator lens 25, and a vertically extending light shield 31.

The baffle component 21 has a plurality of rectangular vertical baffles, e.g. 22, with an aperture 26 for passing light located between each pair of vertical baffles 22. In one embodiment, the height H1, width W, and thickness T of the baffles 22 are, respectively, 0.5 inches high by 0.75 inches wide by 0.125 inches thick. In one embodiment, the baffles 22 are spaced 0.535 inches apart from one another to correspond with the spacing of the LEDs 19. In one embodiment, the apertures 26 are rectangular slits of width 0.064 inches, but could have other widths or other shapes in other embodiments.

In one embodiment, the glare shield 23 is trapezoidal in cross section. The glare shield 23 has a plurality of apertures or slits 24 in its generally rectangular top surface 30. In one embodiment, these slits 24 are equally spaced apart from one another, and each slit 24 has dimensions of 0.375 inches wide by 0.75 inches long. In one embodiment, each aperture 24 is centrally positioned over one of the apertures 26 in the baffle 21. The apertures 24 may have other shapes in other embodiments, for example, such as circular.

In one embodiment, the collimator lens 25 is a Fresnel lens. In one embodiment, the collimator lens 25 is eleven inches long and slides into a horizontal slit 28 in the glare shield 23. In such an embodiment, the circuit board 17 may be 11.13 inches long. Different dimensions of course may be used in other embodiments.

In one illustrative embodiment, the circuit board mounting platform 15 may be mounted in conforming channels in the base 13. The horizontal baffle/aperture component 21 is positioned above the circuit board mounting platform 15 and the LEDs 19, and the LED glare shield 23 with collimator lens 25 in place is mounted down over the baffle/aperture component 21 so as to encase it. In an alternate embodiment, the baffle/aperture component 21 and glare shield 23 may be formed as a single component, for example, by a 3D printing process.

In one embodiment, the base 13 may be an extruded metal material such as aluminum, and the circuit board mounting platform 15 is cast from aluminum. The horizontal baffle/aperture 21 may be formed, for example, of thermoplastic, and the glare shield 23 may be fabricated of polycarbonate. The collimator lens 25 may also be formed of polycarbonate. Other suitable materials can of course be used for all these components in other embodiments.

As noted above, in one embodiment, the baffle/aperture component 21 includes a plurality of rectangular baffle elements 22. In between each baffle element 22 is an aperture 26, each of which is positioned to allow passage of light generated by a respective one of the LEDs 19. In one embodiment, an aperture 26 is positioned over each LED 19. In one embodiment, the LED glare shield 23 includes a plurality of slits 24, which are each positioned over a respective one of the LEDs 19.

In operation of the light module 11, the collimating lens 25 focuses the light generated by the LEDS 19 into a narrow beam, the baffles 22 serve to cut-off or limit the exiting angle of light from the apertures 26, which would result in undesirable lateral spread of light, and the glare shield 23 blocks light reflected from the internal surfaces of the baffles 22 and the lens holder from being visible to an observer on the ground or floor when located more than a few feet from the resulting light pattern on the ground or floor.

In one embodiment, the circuit board 17 may be attached to the circuit board mounting platform 15 by thermal adhesive. In one embodiment, the circuit board mounting platform 15 pivotally engages one side of the base 13, rests on the other side, and is fastened with screws, for example, as illustrated in U.S. Pat. Nos. 9,458,995 and 9,803,807, both incorporated by reference herein.

In one embodiment, the light fixture module 11 may be mounted or positioned at a height of, for example, forty feet above a surface to be illuminated. In one such embodiment, the baffle/aperture 21, glare shield 23, and collimator lens 25 may be constructed to generate a narrow primary beam angle which is three feet wide at an aisle way surface (an angle of 4.3 degrees), while having a limited stray light "spill zone" of about six inches. In various embodiments, theatre pathways three to five feet wide may be illuminated from a module 11 positioned forty feet above the theatre pathway. Other embodiments may be constructed to light similar width pathways from different heights, for example, such as thirty feet. Additional aspects of illustrative LED light modules are discussed in U.S. Pat. No. 10,222,012, assigned to Tempo Industries, LLC, which is incorporated by reference herein in its entirety.

Figure 3:
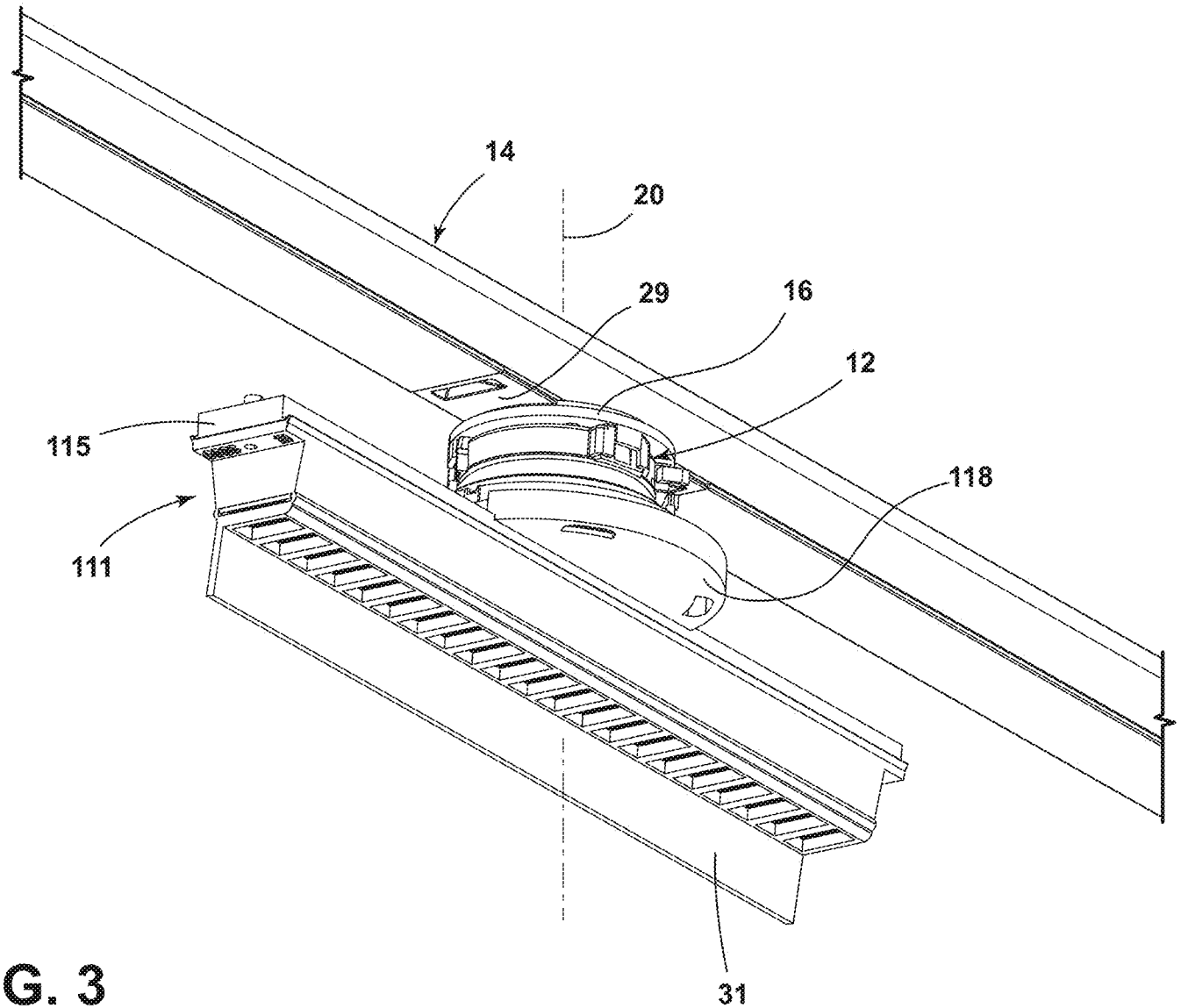
FIG. 3 is a perspective view of a second illustrative embodiment of a ceiling-based LED light module positioning system.

A second illustrative embodiment of an auditorium house light positioning system is shown in FIG. 3. The system of FIG. 3 includes a ceiling track mounting assembly 14, a rotator assembly 16, a positioning motor 12, and an LED light module 111. The ceiling track mounting assembly 14 facilitates attaching the system to a ceiling of an auditorium, the rotator assembly 16 enables rotating the LED light module 111 about a vertical axis 20 of the system, and the positioning motor 12 enables pivotal positioning of the LED light module 111 as described in more detail below.

Figure 4:
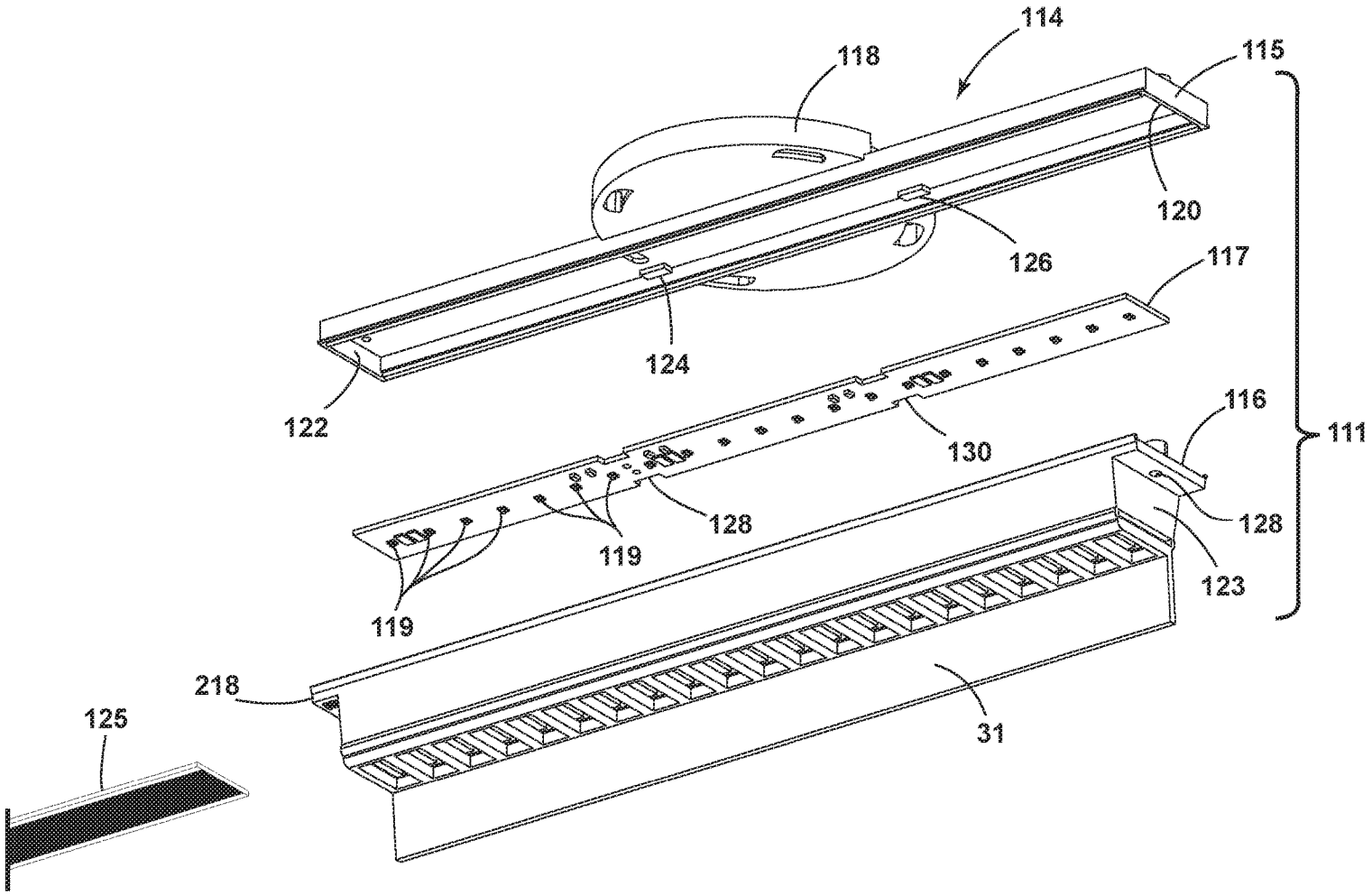
FIG. 4 is an exploded perspective view of components of the embodiment of FIG. 3.

The illustrative LED light module 111 of FIG. 3 is illustrated in FIG. 4. Here, a baffle component and glare shield, such as baffle 21 and glare shield 23 of FIG. 2, are formed as a single component 123, for example, by a 3D printing process. A single piece motor/module mount component 114 is also provided, which includes a circuit board mounting platform 115 and a circular disc component 118. In various embodiments, the single piece motor/module mount component 114 may be cast or molded aluminum so as to perform a heat sink function for a circuit board 117 mounting LEDs, e.g., 119. Various other materials may be used to fabricate component 114 in other embodiments.

The circuit board 117 may be attached to the floor of the circuit board mounting platform 115 by thermal adhesive tape and is aligned by tabs, e.g., 124, 126, which mate with slots, e.g., 128, 130 formed in the circuit board 117. The baffle/glare shield component 123 fits into the circuit board mounting platform 115 with its ends 116, 218 lying adjacent respective inner end surfaces 120, 122 of the mounting platform 117 and is fastened to the mounting platform 117 by fastening devices inserted through holes, e.g. 128, at its opposite ends.

Figure 5:
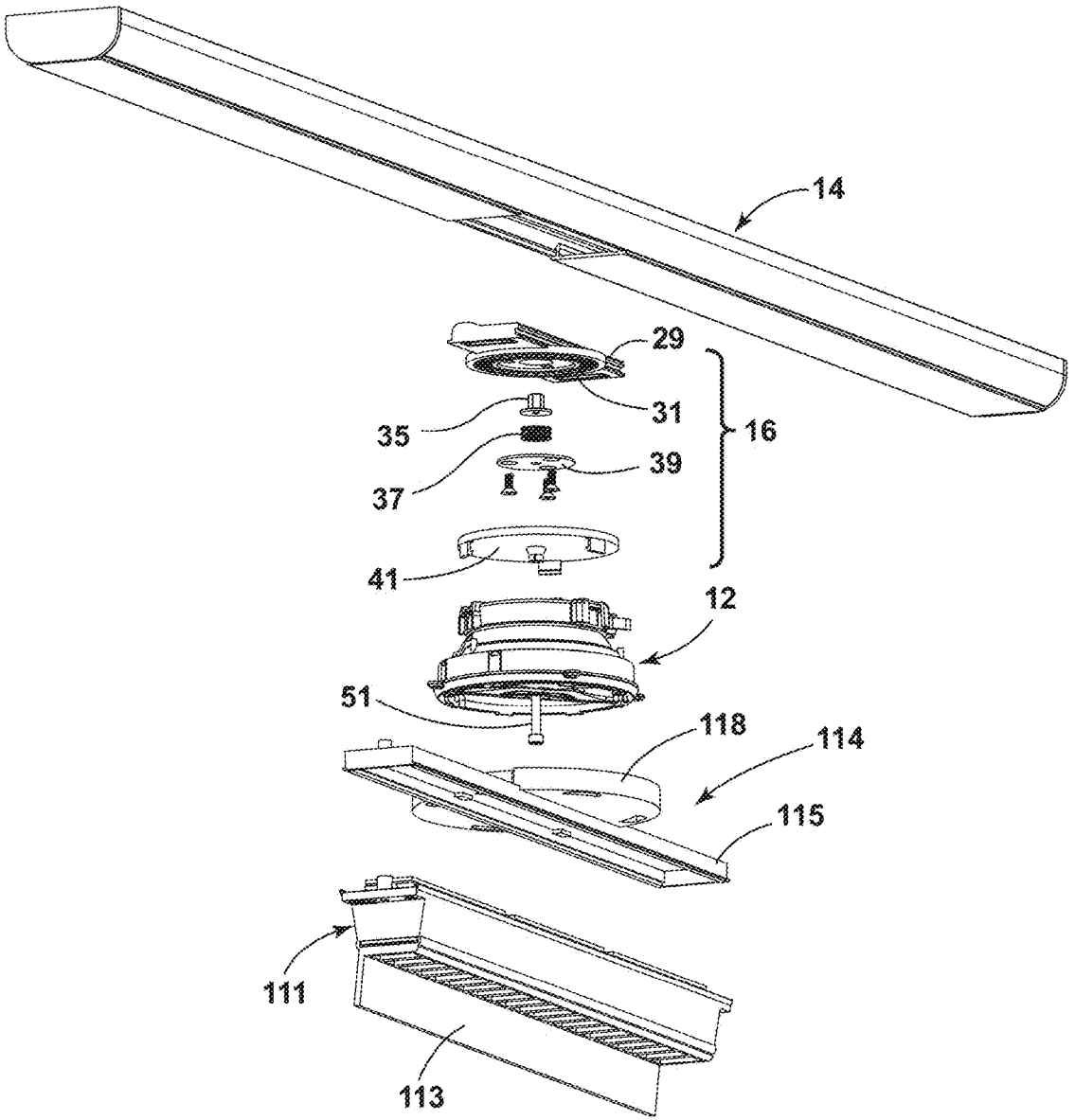
FIG. 5 is an exploded perspective view further illustrating componentry of the embodiment of FIG. 3.
Figure 6:
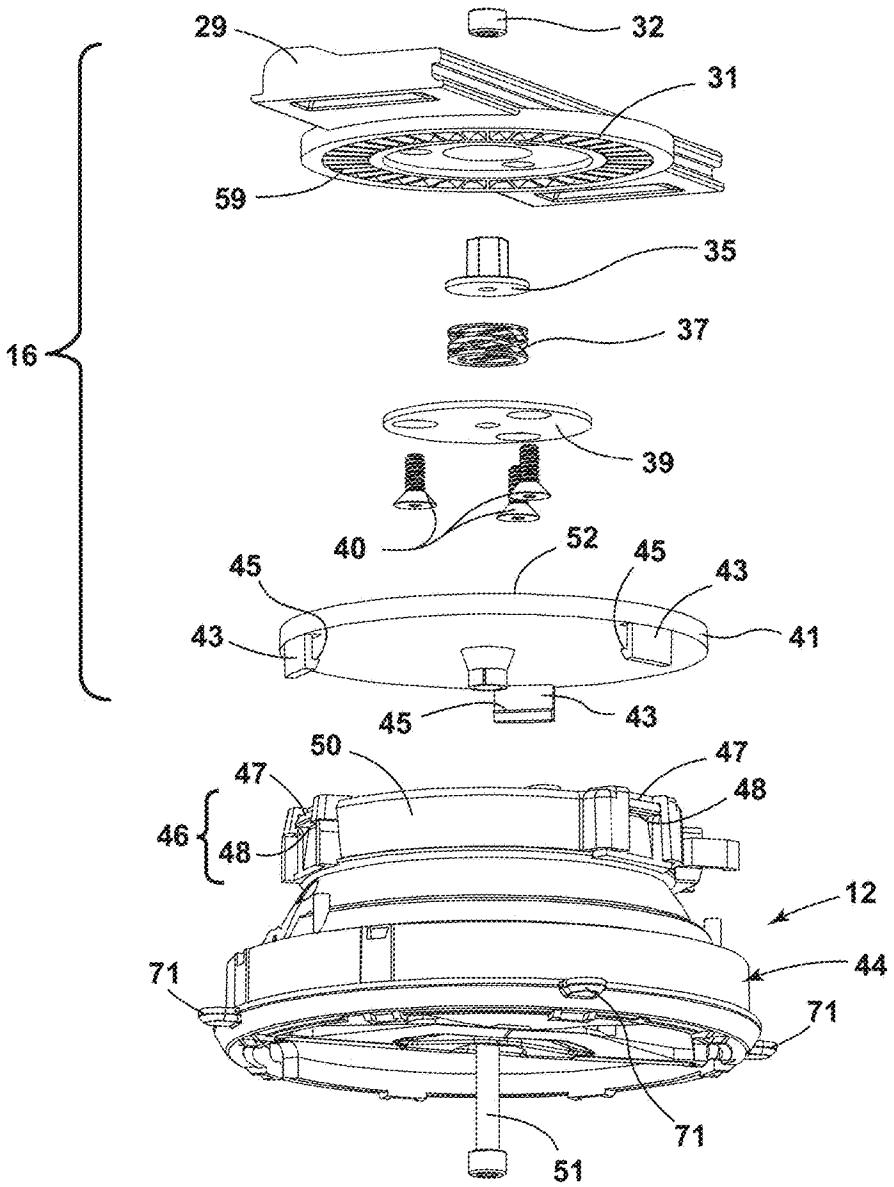
FIG. 6 is an enlarged perspective view of positioning system componentry shown in FIG. 5.

As shown in FIGS. 5 and 6, the light fixture positioning system of the illustrative embodiment includes the mounting track 14 and the rotational positioning system 16, which comprises a circular fixture mount indexer component 31, a rectangular slider 29, a plunger 35, a wave disc spring 37, a locking plate 39, and a circular motor mount indexer component 41. The positioning system further includes the positioning motor 12, the motor/module mount component 114 and a socket cap screw 51. With reference to FIG. 5, the shaft of the socket cap screw 51 passes through central openings in each of the components 12, 41, 39, 37, 35, 31, and 29, and a threaded cap 32 threads on to the end of the screw 51 to hold the entire assembly of FIG. 5 together. In another embodiment, the screw 51 is arranged to thread into the plunger 35, and the cap 32 is not necessary.

Figure 7:
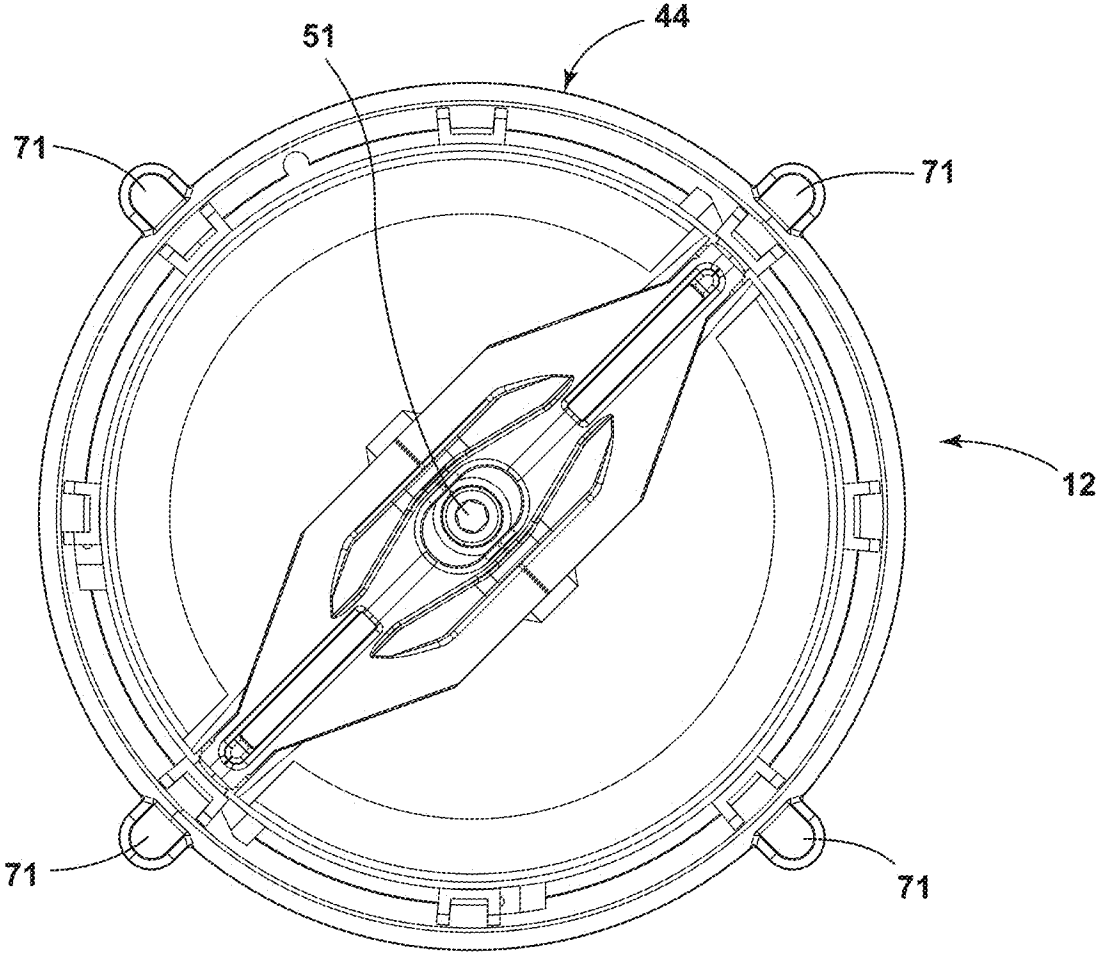
FIG. 7 is a top view of a positioning motor according to an illustrative embodiment.
Figure 8:
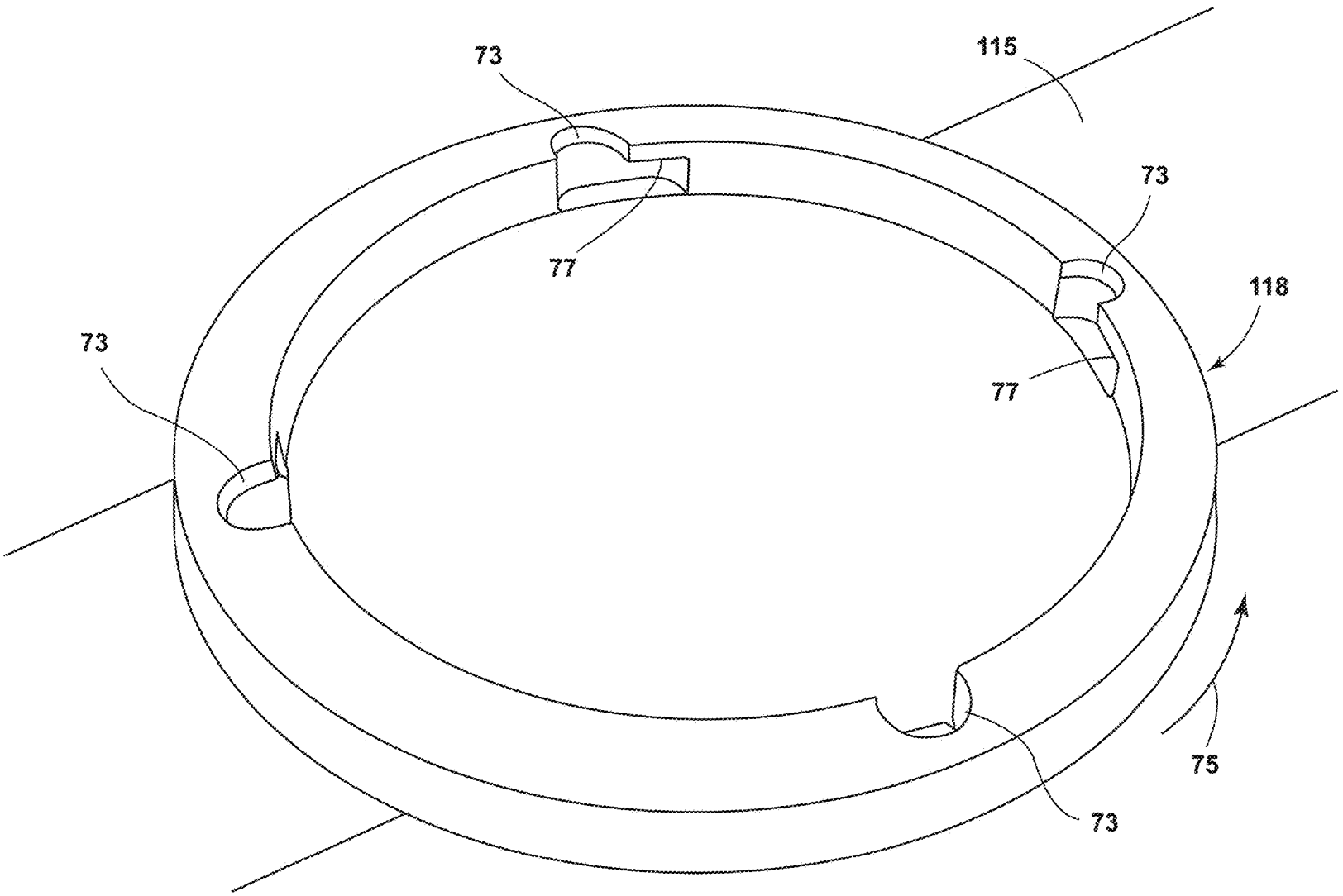
FIG. 8 is a perspective view of a circular disc component configured to attach to the positioning motor of FIG. 7.

As shown in FIG. 5, the positioning motor 12 includes a movable portion or adjusting ring 44, which moves with respect to a fixed actuator portion 46, so as to provide pivoting of the light module 111 about orthogonal X and Y axes. As illustrated in FIGS. 7 and 8, horizontally projecting ears 71 on a lower rim of the adjusting ring 44 are positioned to be inserted downwardly into slots 73 formed in the disc component 118. The disc component 118 may then be twisted in the direction of the arrow 75 (FIG. 8) to cause the ears 71 to enter respective channels 77, thereby interlocking the disc component 118 with the adjusting ring 44. The circular disc component 18 of FIG. 2 may be configured in the same manner to interlock with the adjusting ring 44 so as to provide pivoting of the light module 11 in the same manner.

Figure 9:
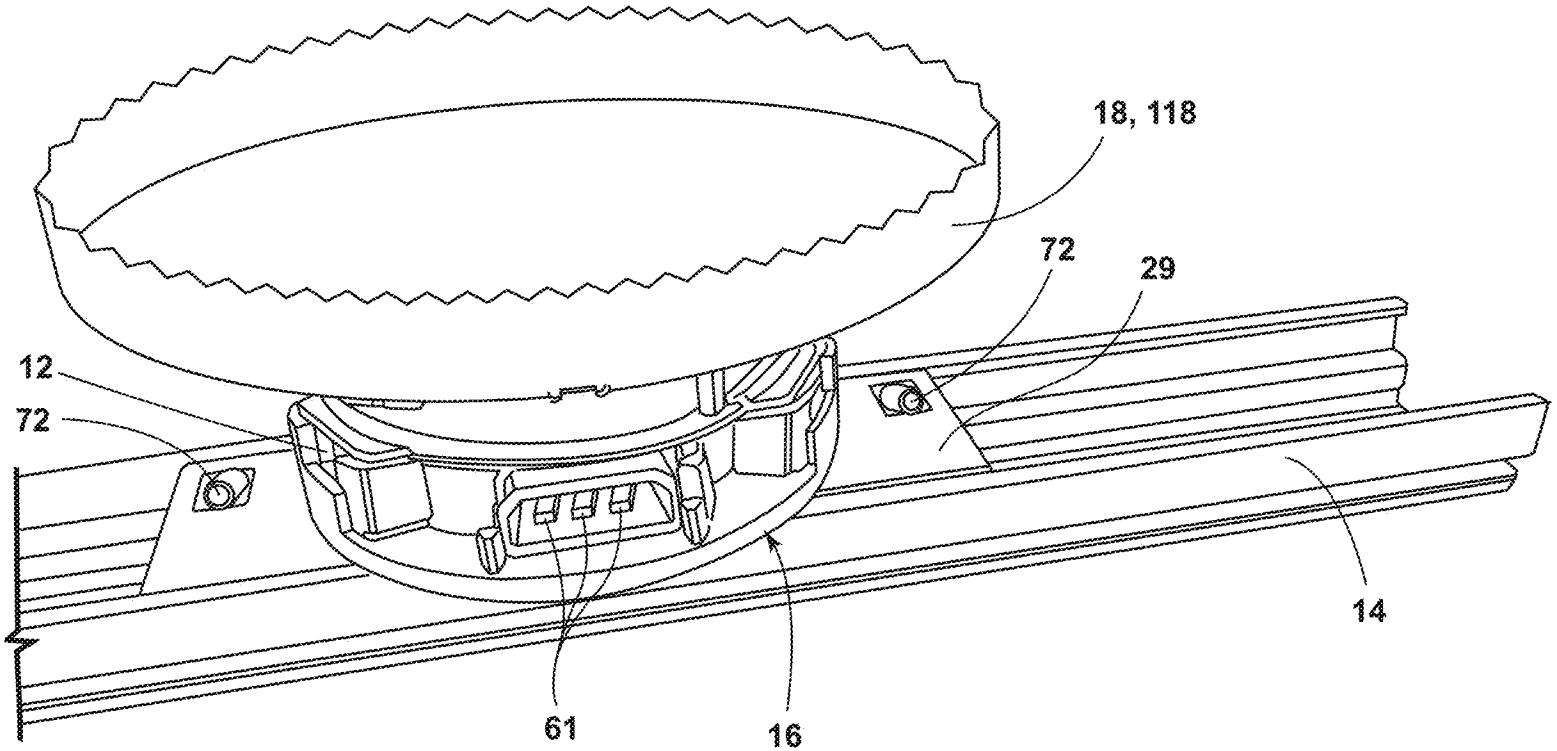
FIG. 9 is a perspective view illustrating attachment of the positioning componentry to a mounting track according to an illustrative embodiment.

With respect to FIG. 6, in an illustrative embodiment, the circular fixture mount indexer component 31 and the rectangular slider 29 may be formed as a single component. In one embodiment, the rectangular slider 29 has lips on respective side edges which slidably engage projections formed on the lower edges of the mounting track 14, which enables the slider 29 to be positioned anywhere along the length of the mounting track 14 and then fastened in position by respective set screws 72, as shown in FIG. 9.

As mentioned above, the rotator assembly 16 of FIG. 6 includes the fixture mount indexer component 31, the motor mount indexer component 41, the plunger 35, the wave disc spring 37, and the locking plate 39. As will be described in more detail, the top surface 52 of the motor mount indexer component 41 has a series of radially arrayed teeth, and the bottom surface 59 of the fixture mount indexer component 31 has a set of matching radially arrayed receptacles arranged to mate with one another. The plunger 35 and spring 37 are held in place by the plate 39 fastened to the indexer component 31 by screws 40 and enable the indexer component 31 and the indexer component 41 to be manually pulled away from one another slightly against a spring bias such that the indexer components 31, 41 can be manually rotated with respect to one another about the vertical axis 20 a selected amount in order to change the rotational positioning of the LED light module 11, 111. After the desired change of position is effected, the manual separation of the indexer components 31 and 41 is released, allowing the mating teeth and receptacles of the indexer components 31, 41 to engage and hold the LED light module 11, 111 in place at its new rotated position.

As illustrated in FIG. 6, the motor mount indexer component 41 attaches to the stationary portion 46 of the positioning motor 12 by way of depending tabs 43 which have inwardly projecting teeth 45 which engage or interlock with respective projecting surfaces 47 on the motor 12. The projecting surfaces 47 are located at the upper end of respective channels 48 formed on a circular upper side surface 50 of the positioning motor 12.

Figure 10:
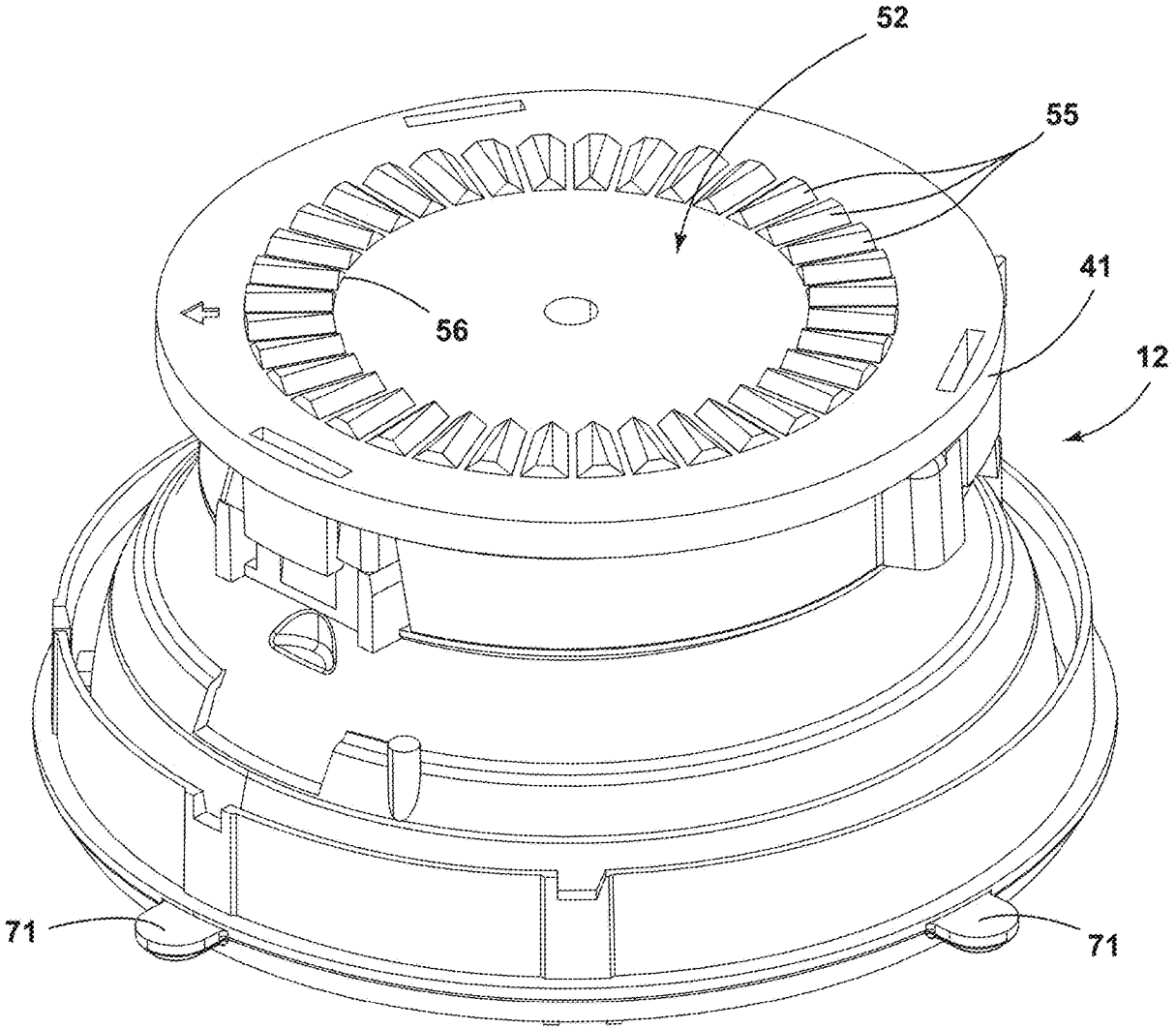
FIG. 10 is a perspective view illustrating a motor mount indexer component according to an illustrative embodiment.
Figure 11:
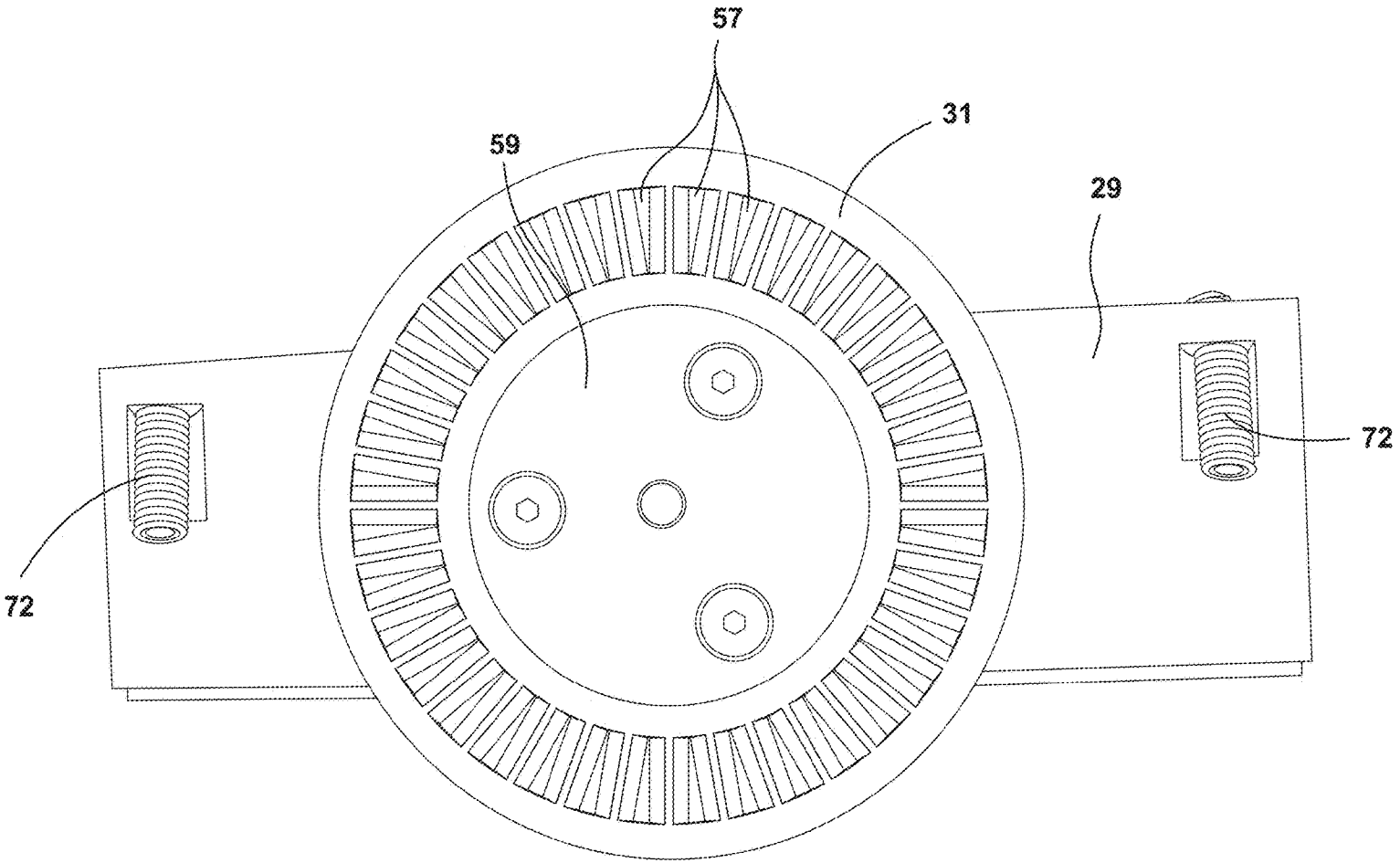
FIG. 11 is bottom view illustrating a fixture mount indexer component according to an illustrative embodiment.

FIG. 10 shows the top surface 52 of an illustrative embodiment of the circular motor mount indexer component 41. As shown, radially arrayed wedge-shaped projections, e.g. 55, are formed around an inner circumference 56 of the indexer component 41. These projections 55 are arranged to mate with matching radially arrayed wedge-shaped depressions 57 on the bottom surface 59 of the fixture indexer component 31, as shown in FIG. 11. The number of projections 55 and depressions 57 may be selected to achieve incremental rotation of the components 31, 41 with respect to one another about the vertical axis 20 in increments of, for example, 5 or 10 degrees.

In one embodiment, the positioning motor 12 is a motor conventionally employed as a mirror actuator, for example, for rear view mirrors of automobiles. In one embodiment, the motor 12 may be a 300 series mirror actuator as available from MCi (Mirror Controls International), www.microcontrols.com. The motor provides X and Y coordinate pivoting in response to control signals provided via three input terminals 61 shown in FIG. 9.

In one embodiment, control signals for controlling the motor 12 and thereby fine tuning the position of the LED light module 11 are supplied wirelessly from floor level to the motor 12 located 30 to 40 feet above an auditorium aisle or pathway. In one embodiment, Blue Tooth protocol may be employed, and positioning may be controlled by a software application providing a digital "joystick" displayed on a touch screen 81 of a laptop, notepad, tablet or other similar digital device, as shown in FIG. 12.

Figure 12:
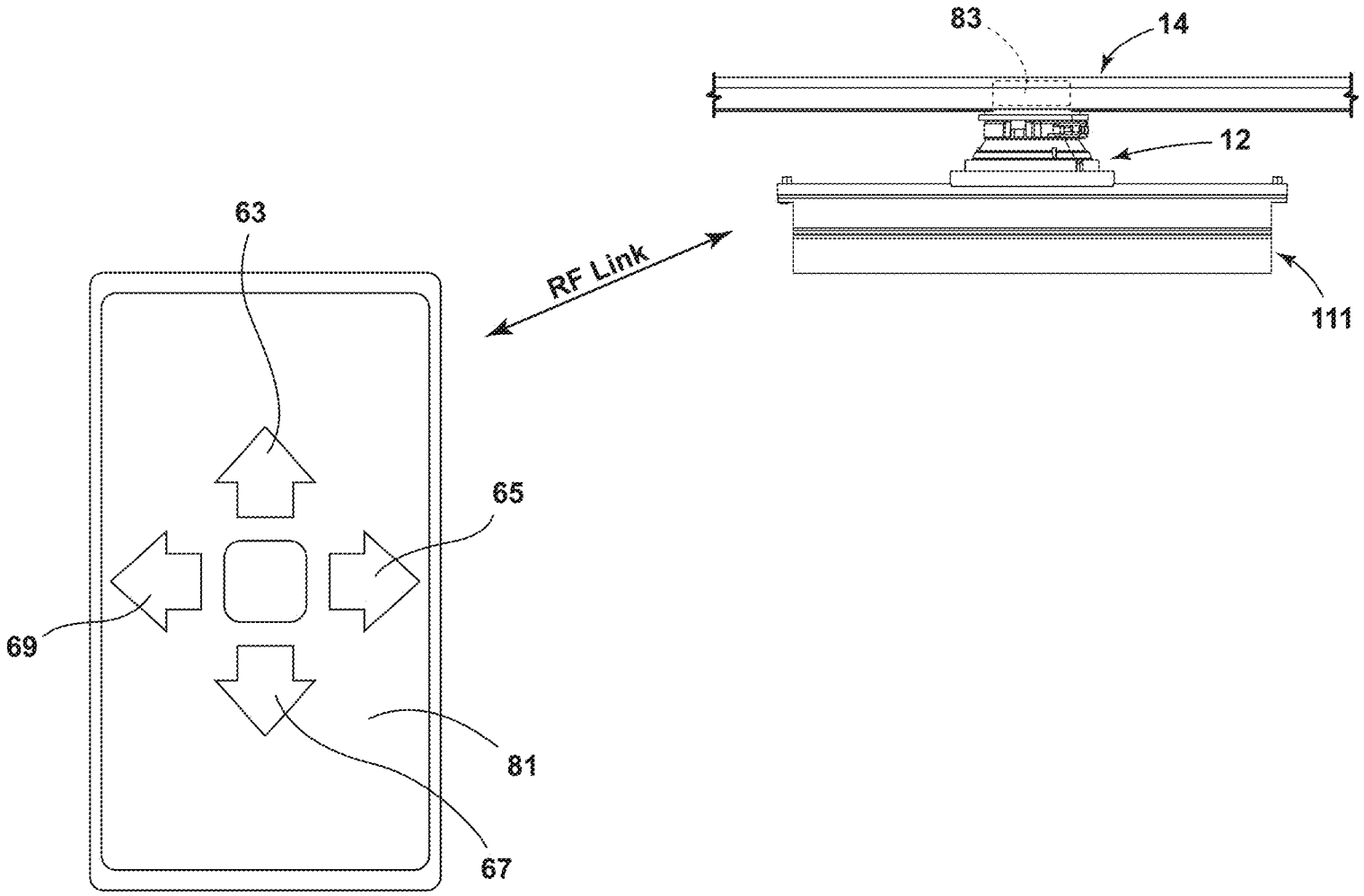
FIG. 12 illustrates a touch screen positioning system according to an illustrative embodiment.

In one embodiment, touch screen positioning may be provided via use of a touch screen display employing four orthogonal arrows 63, 65, 67, 69 shown in FIG. 12. A suitable Blue Tooth receiver 83 is located in conjunction with the ceiling mounted fixture to receive and decode the control signals and supply them in the appropriate format to the positioning motor 12. Other wireless communication protocols can be employed in other embodiments, for example, such as IEEE 802.11 protocols ("WiFi").

Figure 13:
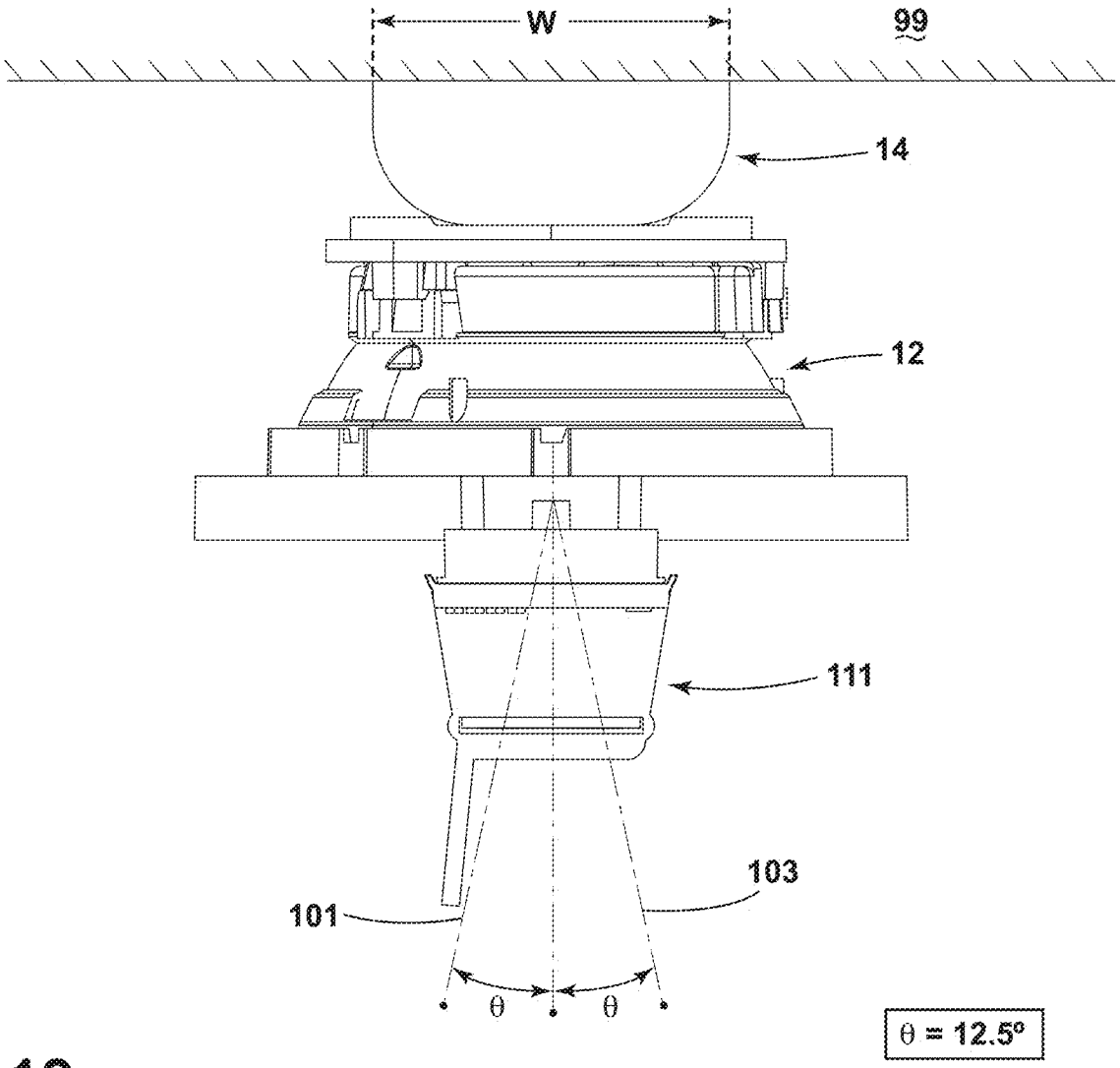
FIG. 13 is an end view illustrating adjustment of light module positioning according to an illustrative embodiment.

FIG. 13 schematically illustrates positioning control achievable in an illustrative embodiment from an end view of an aisle or pathway. In FIG. 12, the guide track 14, which, in one embodiment, may have a width W of, for example, of 1.25 inches, is attached to a ceiling 99 of an auditorium, and the positioning motor 12 is attached to position a light module 11, 111. The dashed lines 101, 103 show the maximum angular positioning of the light module 11, 111 to the left (line 101) and to the right (line 103). In an illustrative embodiment, the angle theta is 12.5 degrees, and the light module 11, 111 may be pivoted to any angle within that range by the motor 12.

Figure 14:
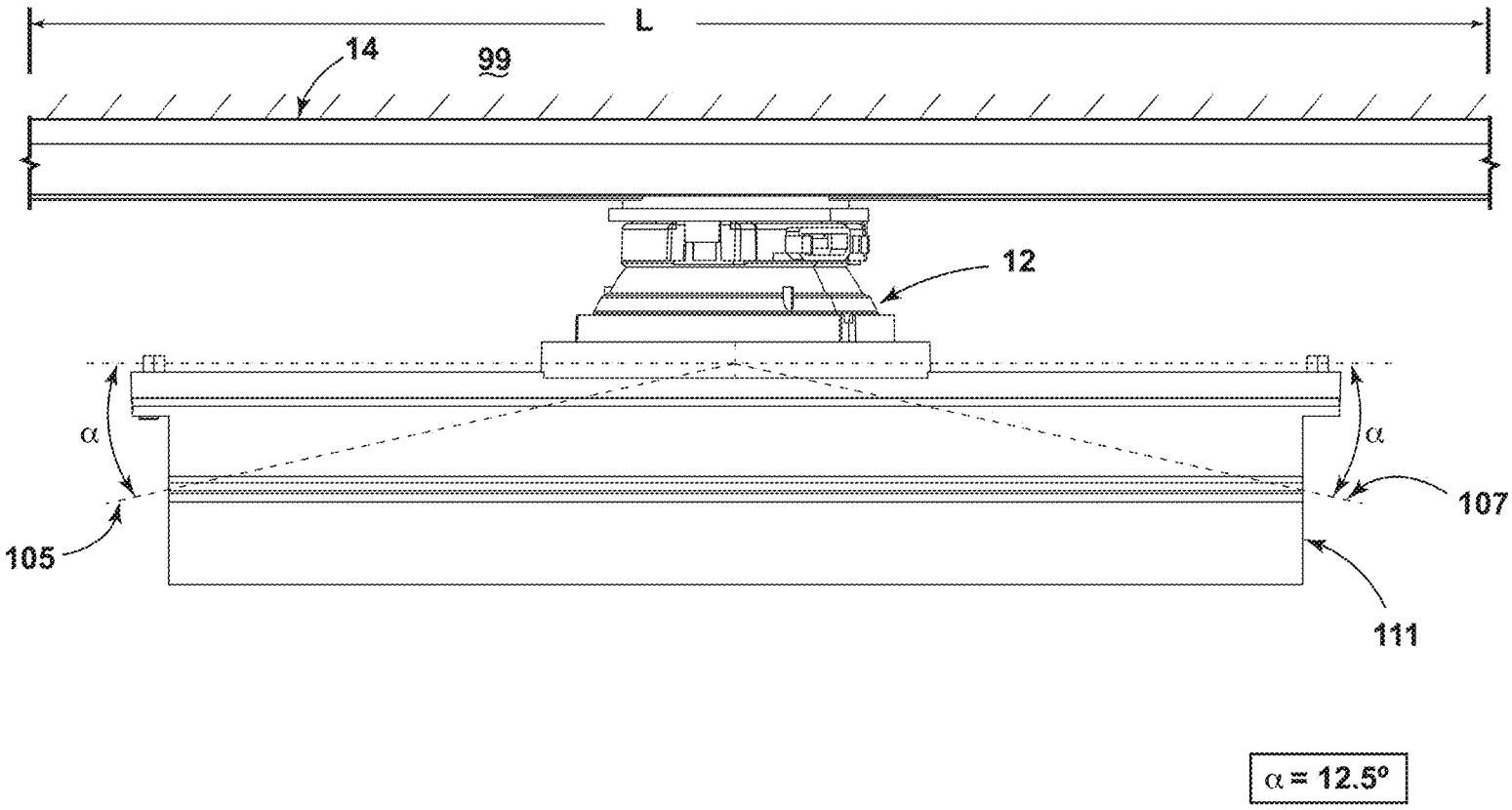
FIG. 14 is a side view illustrating adjustment of light module positioning according to an illustrative embodiment.
Figure 15:
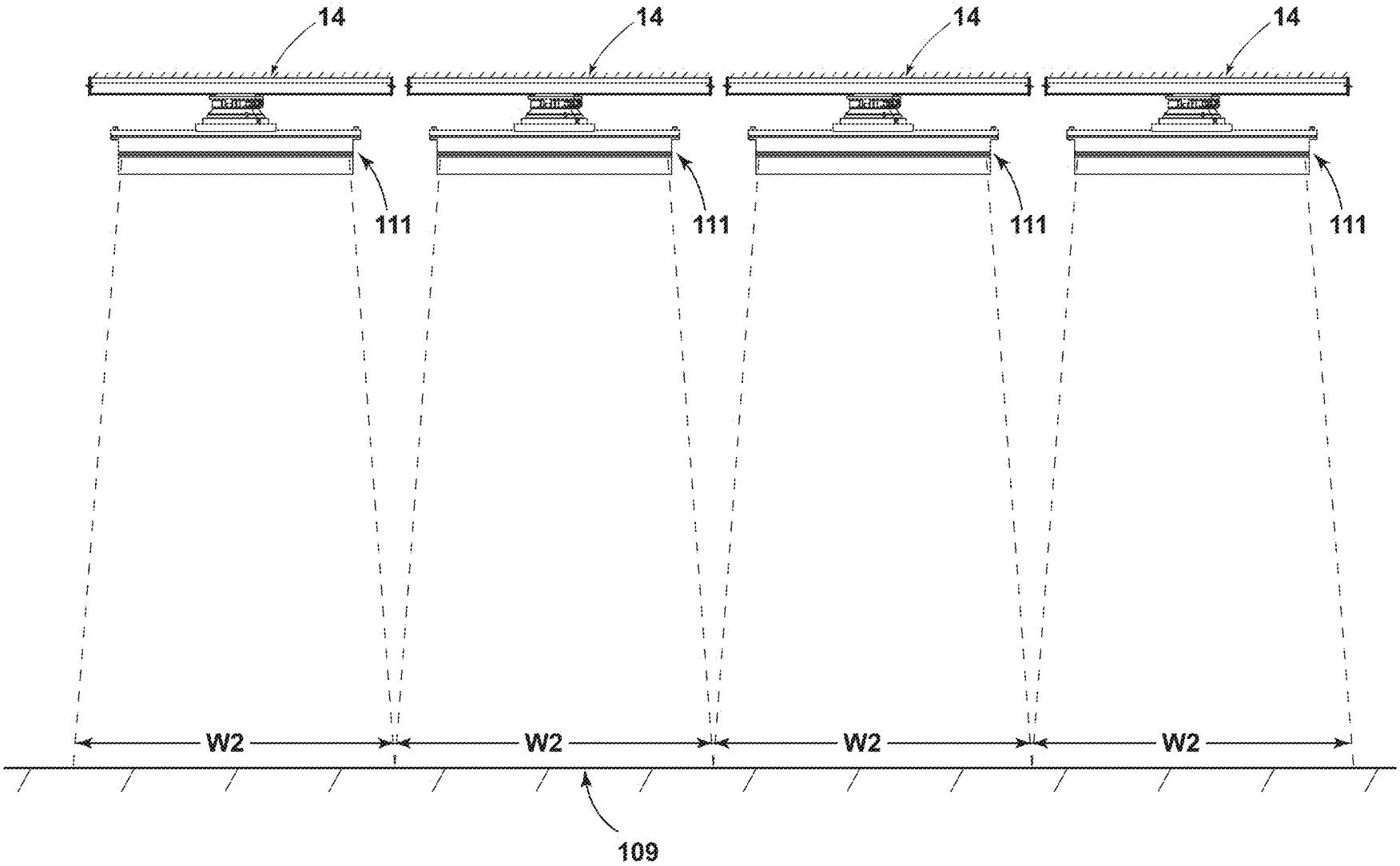
FIG. 15 is a schematic view illustrating an installation of a plurality of LED light module positioning systems linearly in a row above an aisle way.

FIG. 14 schematically illustrates positioning control achievable in an illustrative embodiment from a side view down the length L of an aisle or pathway. The dashed lines 105, 107 show the maximum downward angular positioning of the light module 11 to the left (line 105) and to the right (line 107). In an illustrative embodiment, the angle alpha is 12.5 degrees, and the light module 11, 111 may be pivoted to any angle within that range by the motor 12. In practice, several guide tracks 14, for example, each four feet in length are positioned down the length of the aisle way, as shown in FIG. 14. In the illustrative embodiment of FIG. 14, the beam width W2 produced at the aisle floor 109 by each light module 11, 111 may be four feet.

To configure and install a system according to an illustrative approach, the LED light module components and positioning components of FIG. 4 and FIG. 6 are pre-assembled together and attached to the mounting track 14 at the factory. The mounting track 14 may then be installed in a ceiling above an aisle way, for example, by attaching it to a T-bar ceiling framework or to a ceiling drywall panel. Once the system is installed in the fashion just described, the rotational adjustment mechanism 16 may be manually manipulated at ceiling level to manually rotate the light module 111 to more accurately direct its light beam on to the aisle way to be illuminated. The positioning motor 12 may then be remotely controlled from the floor to fine tune the positioning of the light beam with respect to the aisle way and adjacent seating.

The just described positioning system provides a number of advantages, for example, by allowing fine tuning of the aisle lighting positioning without employing scaffolding. Such fine tuning may be necessary, for example, because the ceiling may not be perfectly level. In other cases, it may be necessary or desirable to locate the mounting track 14 in a position which is not directly above the aisle way, for example, to avoid other devices installed in the ceiling such as acoustic speakers or sprinklers.

The light provided at an aisle or pathway surface by a light module 11, 111 in various embodiments may be of such an intensity that the light beam may be positioned between patrons and a movie screen or stage, for example, to illuminate horizontal aisle ways, while not being visible to those patrons. In one embodiment, a fixture 11, 111 may provide illumination of 0.025 foot candles (fc) at the aisle way surface. In one embodiment, full power on a 12 inch long module 11, 111 puts out 10 fc, and using appropriate electronic dimmers, can be adjusted down to 0.1 fc with a preferred level of >0.2 fc to achieve light levels compliant with National Building Code and similar requirements for egress and safety illumination within movie theater auditoriums and similar public spaces.

Those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. Auditorium or theatre lighting apparatus configured to illuminate an aisle way from a position above the aisle way and comprising:

a mounting track;

a positioning motor having a fixed portion at a first end thereof and a movable portion at an opposite end, the moveable portion being configured to move with respect to the fixed portion so as to provide pivotal positioning of the moveable portion about orthogonal X and Y axes;

a rotator assembly comprising a first indexer component and a second indexer component configured to be rotatable with respect to one another about a vertical axis through a selected range of positions, the second indexer component being attached to the fixed portion of the positioning motor so as to enable rotational positioning of the positioning motor about said vertical axis; and a light module removably attached to the rotator assembly and comprising a plurality of LEDs, the light module being configured to light an aisle way of an auditorium from a position located above the aisle way whereby the light module is rotatable about the vertical axis and pivotable about orthogonal X and Y axes.

2. The apparatus of claim 1 wherein said positioning motor is a mirror actuator.

3. The apparatus of claim 1 wherein a plurality of radially arrayed projections are formed around an inner circumference of a perimeter of the one of the first and second indexer components and the radially arrayed projections are shaped and dimensioned to mate with radially arrayed depressions formed in an opposing surface of the other of the first and second indexer components.

4. The apparatus of claim 3 wherein each of the projections and depressions is wedge-shaped.

5. The apparatus of claim 3 further comprising a spring biased plunger positioned between the first and second indexer components and configured to enable the first and second indexer components to be manually separated from one another so as to facilitate adjustment of the rotational position of the positioning motor.

6. The apparatus of claim 1 wherein the movable portion of the positioning motor comprises an adjustment ring and wherein the light module comprises a circular disc attached to said adjustment ring.

7. The apparatus of claim 1 wherein the first indexer component is attached to a slider component which is mounted in the mounting track.

8. The apparatus of claim 1 wherein the light module comprises a light focusing lens and is configured to focus light from the plurality of LEDs in a beam of a width selected to illuminate a floor of the aisle way.

9. The apparatus of claim 1 wherein the light module is configured to be located 30 feet or more above the aisle way.

10. The lighting apparatus of claim 1 wherein the light module is configured to provide light to a floor of an aisle way, which floor is between three and five feet.

11. The lighting apparatus of claim 1 wherein the light module is configured to provide light to a floor of the aisle way which is at a level of 0.25 foot candles or less.

12. The lighting apparatus of claim 1 wherein the light module is configured to be located 30 feet or more above the aisle way, to illuminate an aisle way floor which is between three and five feet in width, and to provide light to the floor of the aisle way is at a level of 0.25 foot candles or less.

13. Apparatus for use in controlling positioning of a lighting apparatus comprising a plurality of LEDs comprising:

a positioning motor having a fixed portion at a first end thereof and a movable portion at an opposite end, the moveable portion being configured to move with respect to the fixed portion so as to provide pivotal positioning of the moveable portion about orthogonal X and Y axes; and a rotator assembly comprising a first indexer component and a second indexer component configured to be rotatable with respect to one another about a vertical axis through a selected range of positions, the second indexer component being attached to the fixed portion of the positioning motor so as to enable rotational positioning of the positioning motor about said vertical axis.

14. The apparatus of claim 13 wherein said positioning motor is a mirror actuator.

15. The apparatus of claim 13 wherein a plurality of radially arrayed projections are formed around an inner circumference of a perimeter of the one of the first and second indexer components and the radially arrayed projections are shaped and dimensioned to mate with radially arrayed depressions formed in an opposing surface of the other of the first and second indexer components.

16. The apparatus of claim 15 wherein each of the projections and depressions is wedge-shaped.

17. The apparatus of claim 15 further comprising a spring biased plunger positioned between the first and second indexer components and configured to enable the first and second indexer components to be manually separated from one another so as to facilitate adjustment of the rotational position of the positioning motor.

18. The apparatus of claim 13 wherein the movable portion of the positioning motor comprises an adjustment ring.

19. The apparatus of claim 13 wherein the first indexer component is attached to a slider component which is configured to attach to a mounting track.

20. The apparatus of claim 13 wherein the movable portion of the positioning motor is operatively connected to the lighting apparatus so as to enable rotational positioning of the lighting apparatus about the vertical axis and pivotal positioning of the lighting fixture about orthogonal X and Y axes.

21. The apparatus of claim 20 wherein the lighting apparatus comprises a circuit board mounting a plurality of LEDs.

22. A method of controlling positioning of a lighting apparatus comprising a plurality of LEDs, the method comprising:

providing a positioning motor having a fixed portion at a first end thereof and a movable portion at an opposite end, the moveable portion being configured to move with respect to the fixed portion so as to provide pivotal positioning of the moveable portion about orthogonal X and Y axes;

constructing a rotator component so as to be attachable to the positioning motor and so as to be capable of rotating the positioning motor about a vertical axis between a number of selected rotational positions; and operatively connecting a lighting apparatus comprising a plurality of LEDs to the moveable portion of the positioning motor so as to enable rotational positioning of the lighting apparatus about the vertical axis and pivotal positioning of the lighting fixture about orthogonal X and Y axes.

23. The method of claim 22 further comprising configuring a mounting track to be installable in a ceiling and attaching the rotator component to the mounting track.

* * * * *